US006788185B2

(12) United States Patent
Fujiwara et al.

(10) Patent No.: US 6,788,185 B2
(45) Date of Patent: Sep. 7, 2004

(54) POWDER CORE AND HIGH-FREQUENCY REACTOR USING THE SAME

(75) Inventors: Teruhiko Fujiwara, Sendai (JP); Masayoshi Ishii, Sendai (JP); Yoshitaka Saito, Sendai (JP)

(73) Assignee: NEC Tokin Corporation, Miyagi (JP)

( * ) Notice: Subject to any disclaimer, the term of this patent is extended or adjusted under 35 U.S.C. 154(b) by 0 days.

(21) Appl. No.: 10/630,193

(22) Filed: Jul. 29, 2003

(65) Prior Publication Data

US 2004/0021542 A1 Feb. 5, 2004

Related U.S. Application Data

(62) Division of application No. 10/052,702, filed on Jan. 17, 2002, now Pat. No. 6,621,399.

(51) Int. Cl.[7] ..... H01F 27/28

(52) U.S. Cl. ..... 336/229; 336/233; 252/62.54; 252/62.55; 252/62.59; 148/104

(58) Field of Search ..... 336/229, 233, 336/178; 252/62.54, 62.55, 62.59; 419/10; 75/230; 148/104

(56) References Cited

U.S. PATENT DOCUMENTS 4,272,749 A * 6/1981 Tuji ..... 336/233
4,637,843 A * 1/1987 Takayama et al. ..... 420/73
4,956,011 A * 9/1990 Nishida et al. ..... 75/230

FOREIGN PATENT DOCUMENTS

JP 363291859 A * 11/1988
JP 2-290002 A 11/1990
JP 9-180924 A 7/1997

* cited by examiner

*Primary Examiner*—Lincoln Donovan
*Assistant Examiner*—Jennifer A. Poker
(74) *Attorney, Agent, or Firm*—Frishauf, Holtz, Goodman & Chick, P.C.

(57) ABSTRACT

A powder core is obtained by compaction-forming magnetic powder. The magnetic powder is an alloy comprising 1–10 wt % Si, 0.1–1.0 wt % O, and balance Fe. An insulator comprising $SiO_2$ and MgO as main components is interposed between powder particles having a particle size of 150 μm or less.

3 Claims, 8 Drawing Sheets

POWDER CORE AND HIGH-FREQUENCY REACTOR USING THE SAME

This application is a divisional application of application Ser. No. 10/052,702 filed Jan. 17, 2002 now U.S. Pat. No. 6,621,399, now allowed, which is incorporated herein by reference in its entirety.

BACKGROUND OF THE INVENTION

This invention relates to a powder core for use in a choke coil and, in particular, to a powder core excellent in d.c. superposition characteristic and frequency characteristic.

For a choke coil used at a high frequency, a ferrite core or a powder core is used. In these cores, the ferrite core is disadvantageous in that the saturation flux density is small. On the other hand, the powder core produced by forming metal powder has a high saturation flux density as compared with soft magnetic ferrite and is therefore advantageous in that the d.c. superposition characteristic is excellent.

However, since the powder core is produced by mixing the metal powder and an organic binder or the like and compaction-forming the mixture under a high pressure, insulation between powder particles can not be kept so that the frequency characteristic of the permeability is degraded, In case where the binder is mixed in a large amount in order to assure the insulation between the powder particles, a space factor of the metal powder is reduced so that the permeability is decreased.

In recent years, energy saving and global warming due to carbon dioxide are growing into serious problems. In view of the above, energy saving strategy is rapidly developed in domestic electrical appliances and industrial apparatuses. To this end, it is required to increase the efficiency of an electric circuit. As one of solutions, it is strongly desired to improve the permeability of the powder core, the frequency characteristic, and the core loss characteristic.

In an existing method of improving the permeability of the powder core, a principal point is put on an improvement of a packing fraction of magnetic powder. For this purpose, it is proposed, for example, to increase a forming pressure. If the packing fraction is improved in this manner, however, the insulation between the powder particles is degraded to result in an increase in eddy current loss and deterioration in frequency characteristic.

SUMMARY OF THE INVENTION

It is therefore an object of this invention to solve the above-mentioned problem and to provide a powder core excellent in d.c. superposition characteristic and in frequency characteristic.

In order to solve the above-mentioned problem, a study has been made of a method of interposing an insulator between magnetic particles in a powder core. As a result, this invention has been made. As a result of progress in studying how to embody the above-mentioned method, the present inventors found out that the insulator can be interposed between the magnetic powder particles by mixing a raw material of the powder core with powder or a solution containing an $SiO_2$-producing compound and $MgCO_3$ or MgO powder, and pressing and heat-treating a resultant mixture.

According to one aspect of this invention, there is provided a powder core obtained by compaction-forming magnetic powder, wherein the magnetic powder is an alloy comprising 1–10 wt % Si, 0.1–1.0 wt % O, and balance Fe, an insulator comprising $SiO_2$ and MgO as main components being interposed between magnetic powder particles having a particle size of 150 $\mu$m or less.

According to another aspect of this invention, there is provided a high-frequency reactor comprising the above-mentioned powder core and a winding wound around the powder core.

According to still another aspect of this invention, there is provided a method of producing the above-mentioned powder core, comprising the steps of mixing magnetic powder, at least one of silicone resin and a silane coupling agent, and at least one of $MgCO_3$ powder and MgO powder, compaction-forming a resultant mixture into a compact body, and heat-treating the compact body thus obtained.

This invention provides the powder core excellent in d.c. superposition characteristic and frequency characteristic as compared with an existing powder core using the similar magnetic powder. It is understood that, by heat treating the mixture of the $SiO_2$-producing compound and $MgCO_3$ or MgO powder, a glass layer comprising $SiO_2$ and MgO as main components is formed between magnetic particles so that insulation between the particles can be assured without decreasing a packing fraction.

BRIEF DESCRIPTIONS OF THE INVENTION

DESCRIPTION OF THE PREFERRED EMBODIMENTS

Now, description will be made of an embodiment of this invention.

In this invention, an alloy comprising 1–10 wt % Si, 0.1–1.0 wt %, and balance Fe is used as magnetic powder. As far as the composition is uniformly distributed, no restriction is imposed upon a production process of the powder, which may be pulverized powder from an ingot obtained by a solution process, atomized powder, and so on.

In case where the content of oxygen in the powder is 0.1 wt % or less, heat treatment is carried out in an appropriate oxygen atmosphere at an approximate temperature to oxidize a powder particle surface. The powder is classified by the use of a filter of 150 $\mu$m.

Figure 8:
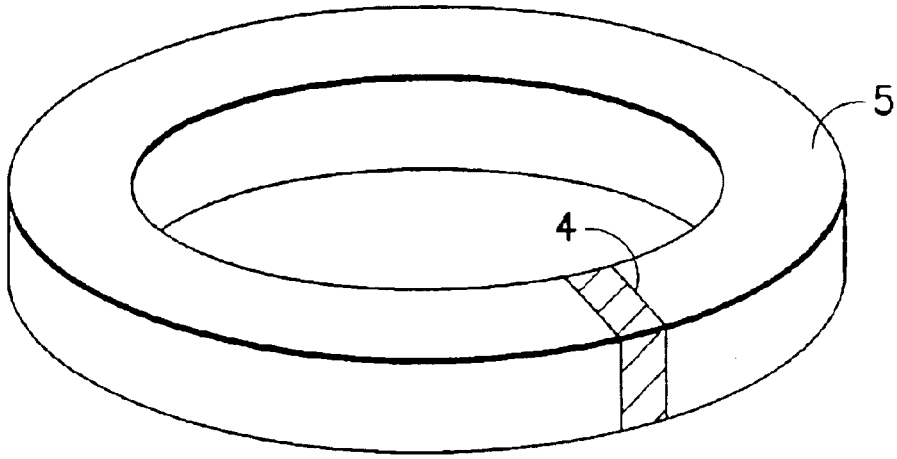
FIG. 8 is a view showing a powder core with a gap of nonmagnetic substance.

FIG. 8 shows a powder core 5 made of the magnetic powder described below, and having a gap of a nonmagnetic substance 4.

Figure 9:
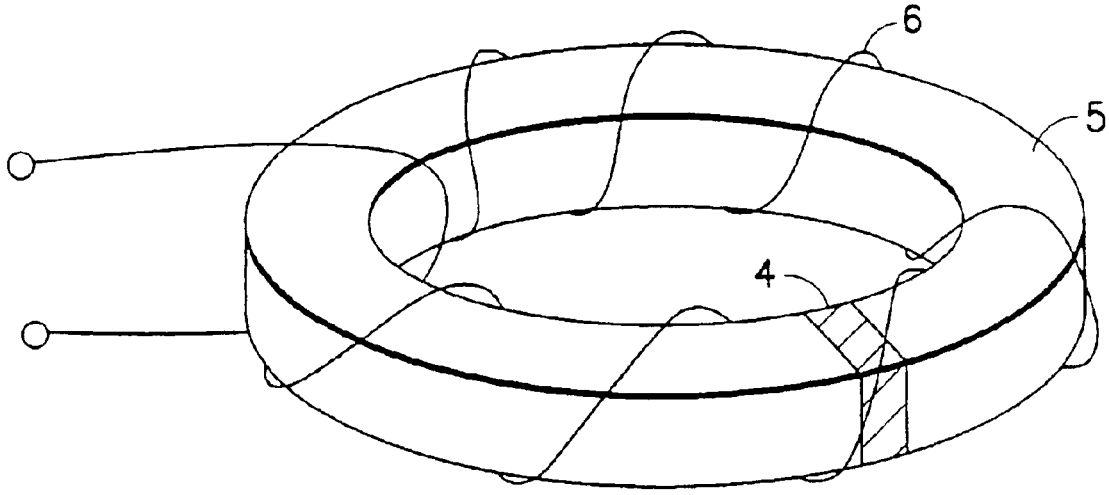
FIG. 9 is a view showing a high frequency reactor with the powder core of FIG. 8.

FIG. 9 shows a high-frequency reactor which comprises the powder core 5 having the gap or the nonmagnetic substance 4 and winding 6 wound around the powder core 5.

On the other hand, a binder may be used in forming a powder core. As a typical binder for the powder core, use is made of a thermosetting macromolecule such as epoxy resin. Since an $SiO_2$-producing compound is used in this invention, use may be made of an adhesive comprising as a main component silicone resin whose main chain is formed by the siloxane bond.

A silane coupling agent includes Si and O as component elements. Therefore, also by mixing the silane coupling agent, $SiO_2$ can be produced by heat treatment. In this case, if the magnetic powder is preliminarily subjected to surface treatment by the silane coupling agent, the packing fraction of the magnetic powder can be improved.

In this invention, $MgCO_3$ powder or MgO power is mixed in order to form an insulator. Since MgO absorbs $CO_2$ or moisture in air to be transformed into $MgCO_3$ hydrate, handling must be careful. On the other hand, $MgCO_3$ releases $CO_2$ at a temperature higher than about 700° C. to be transformed into MgO and therefore provides an effect similar to the case where MgO is used. Thus, depending upon the environment of the production process and the condition of the heat treatment, these materials may appropriately be selected.

For example, compaction-forming is carried out under an appropriate pressure, preferably under a pressure of 5–20 ton/cm$^2$, by the use of a die having a toroidal shape. Then, a resultant compact body is subjected to heat treatment for removing distortion at an appropriate temperature, preferably within a range of 500–1000° C. Next, a magnet wire having a diameter depending upon a rated current is used and the number of turns is determined to obtain a desired inductance value. Herein, description will be made of the reason why the composition of the alloy is defined as described above. If the content of Si is smaller than 1 wt %, the alloy has high magnetic anisotropy and low resistivity which results in an increase in core loss. If the content is greater than 10%, the alloy has low saturation magnetization and high hardness which lowers the density of the compact body. This results in deterioration of the d.c. superposition characteristic. The content of O is 0.1–1.0 wt %. If the content is smaller than 0.1%, the initial permeability is excessively high so that the d.c. superposition characteristic is not improved. If the content is greater than 1.0 wt %, the ratio of the magnetic substance in the powder is decreased so that the saturation magnetization is considerably degraded. This results in deterioration of the d.c. superposition characteristic. The particle size of the powder is substantially equal to 150 $\mu$m or less. The d.c. superposition characteristic tends to increase as the particle size is smaller.

Consideration will be made of the forming pressure. When the powder is formed under the pressure of 5 ton/cm$^2$, a high compact density of 6.0 g/cm$^3$, an excellent d.c. superposition characteristic, and an excellent core loss characteristic are obtained. On the other hand, the forming pressure exceeding 20 ton/cm$^2$ considerably shortens the life of the die for forming the compact body and is therefore impractical.

As regards the heat treatment temperature of the compact body, the temperature not lower than 500° C. removes the forming distortion and improves the d.c. superposition characteristic. On the other hand, the temperature exceeding 1000° C. decreases the resistivity so that the deterioration in high-frequency characteristic is prominent. Presumably, this is because electrical insulation between powder particles is destructed by sintering. This is a definite difference of the powder core according to this invention from the sintered core having a sintered density ratio exceeding 95%. The density of a compact body thereof exceeds 7.0 g/cm$^3$.

Hereinafter, description will be made further in detail in conjunction with various specific examples 1 to 6.

EXAMPLE 1

The alloy powder comprising 5.0 wt % Si and balance Fe was prepared by water atomization. Predetermined amounts of silicone resin, a silane-based coupling agent, $MgCO_3$ powder, and MgO powder were weighed and mixed thereto. By the use of a die, the mixture was formed at the room temperature under the pressure of 15 ton/cm$^2$. Thus, a toroidal-shaped powder core having an outer diameter of 20 mm, an inner diameter of 10 mm, and a thickness of 5 mm was obtained. Table 1 shows weight compositions of the above-mentioned components in this example. Herein, four kinds of powder cores as an example and one kind as a comparative example were produced.

TABLE 1

| | | silicone resin (wt %) | silane coupling agent (wt %) | MgO powder (wt %) | $MgCO_3$ powder (wt %) |
|---|---|---|---|---|---|
| Example | Sample 1 | 0.7 | — | 0.3 | — |
| | Sample 2 | 0.7 | — | — | 0.6 |
| | Sample 3 | — | 0.7 | 0.3 | — |
| | Sample 4 | — | 0.7 | — | 0.6 |
| Comparative Example | | 1.0 | — | — | — |

Figure 1:
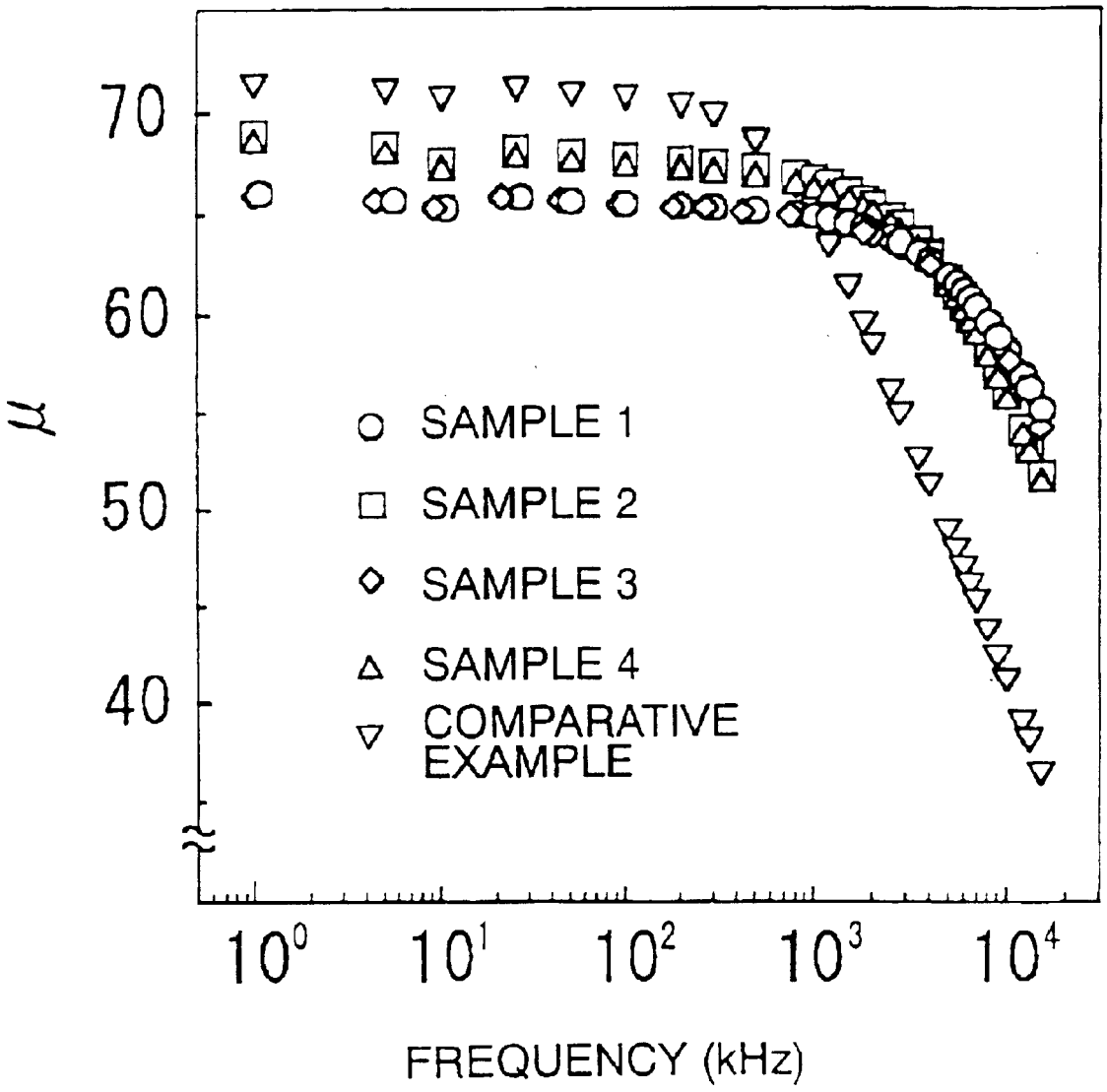
FIG. 1 is a view showing frequency characteristics of powder cores according to an example 1 and a powder core of a comparative example.

Next, the powder core was heat treated in the condition of 800° C., 2 hours, and a nitrogen atmosphere to carry out heat treatment of the silicone resin and removal of distortion upon forming the powder. Then, the powder core was packed into a case made of an insulator and provided with a winding. By the use of the precision meter 4284A manufactured by Hewlett Packard Company (hereinafter represented by HP), the d.c. superposition characteristic was measured. The result is shown in FIG. 1.

Figure 2:
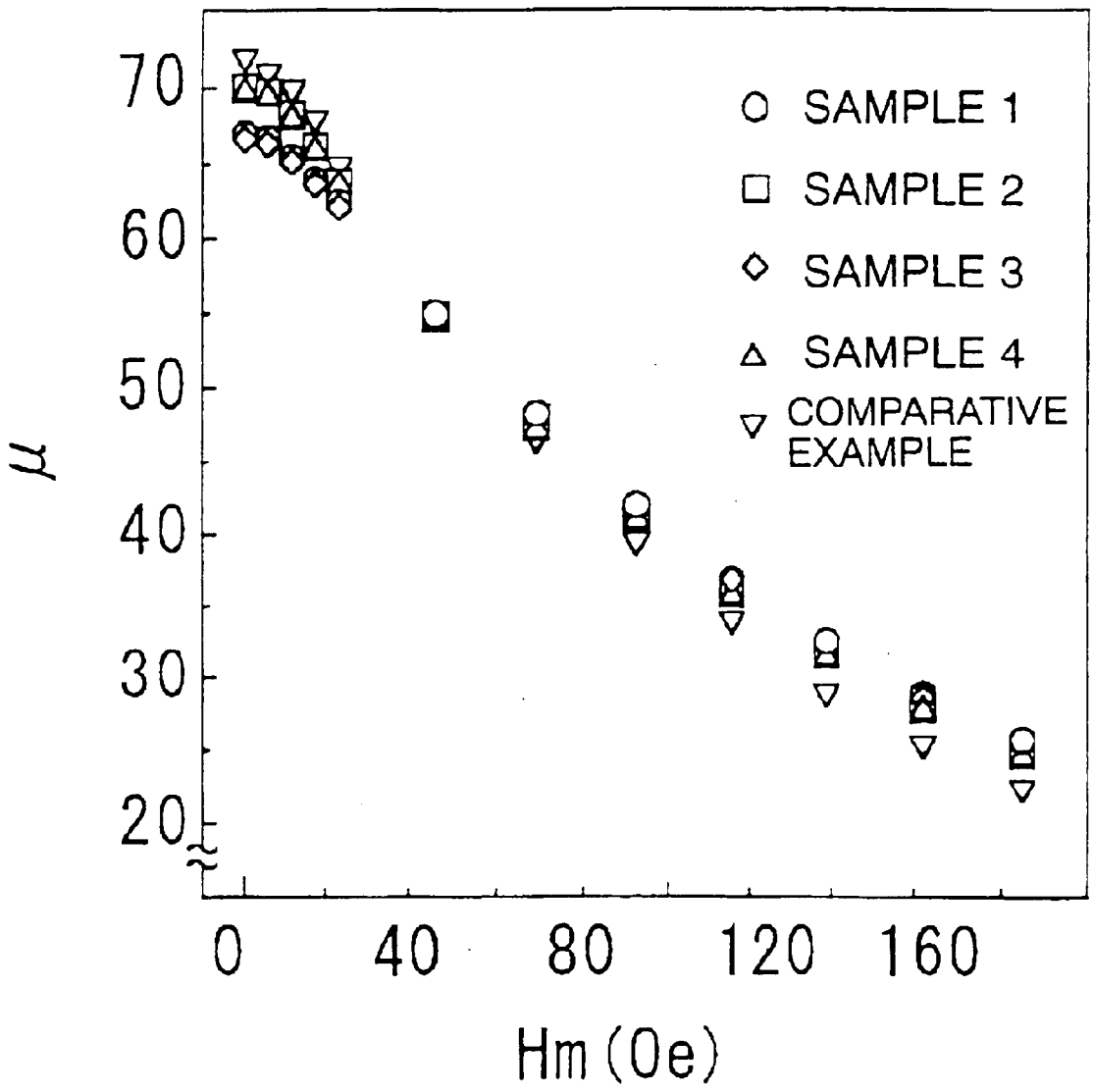
FIG. 2 is a view showing d.c. superposition characteristics of powder cores according to the example 1 and the powder core of the comparative example.

By the use of the impedance analyzer 4194A manufactured by HP, the frequency characteristic at $\mu 20_{kHz}$ was measured. The result is shown in FIG. 2. The result of measurement of the resistivity of each powder core is shown in Table 2. Then, the compact body was provided with a primary winding of 15 turns and a secondary winding of 15 turns. By the use of the a.c. BH analyzer SY-8232 manufactured by Iwatsu Electric, measurement was carried out of the core loss characteristic at 20 kHz and 0.1T The result is also shown in Table 2.

As the comparative example, 1.0 wt % silicone resin alone was mixed as shown in Table 1. In the manner similar to that mentioned above, the powder core was produced and measurements of characteristics were carried out. The results are similarly shown in FIG. 1, FIG. 2, and Table 2.

TABLE 2

| | resistivity (Ω · cm) | core loss (kW/m³) |
|---|---|---|
| Example 1 | 10.2 | 500 |
| Example 2 | 9.6 | 550 |
| Example 3 | 9.8 | 600 |
| Example 4 | 9.9 | 650 |
| Comparative Example | 0.1 | 1200 |

From FIG. 1 and FIG. 2, it is understood that both of the d.c. superposition characteristic and the frequency characteristic are excellent in the powder cores of this example as compared with the comparative example. From Table 2, it is understood that the resistivity and the core loss are also improved in the powder cores of this example.

EXAMPLE 2

Next, description will be made of Example 2. As a sample 1, a raw material was weighed in a mixing ratio shown at the sample 3 in Table 1. In the manner similar to Example 1, the mixture was formed by the use of a die at the room temperature under the pressure of 15 ton/cm$^2$ to obtain toroidal-shaped powder cores having an outer diameter of 20 mm, an inner diameter of 10 mm, and a thickness of 5 mm. Next, the powder cores were heat treated at 400° C., 500° C., 600° C., 700° C., 800° C., 900° C., 1000° C., and 1100° C., respectively, for 2 hours. in a nitrogen atmosphere to carry out heat treatment of the silicone resin and removal of distortion upon forming the powder.

Figure 3:
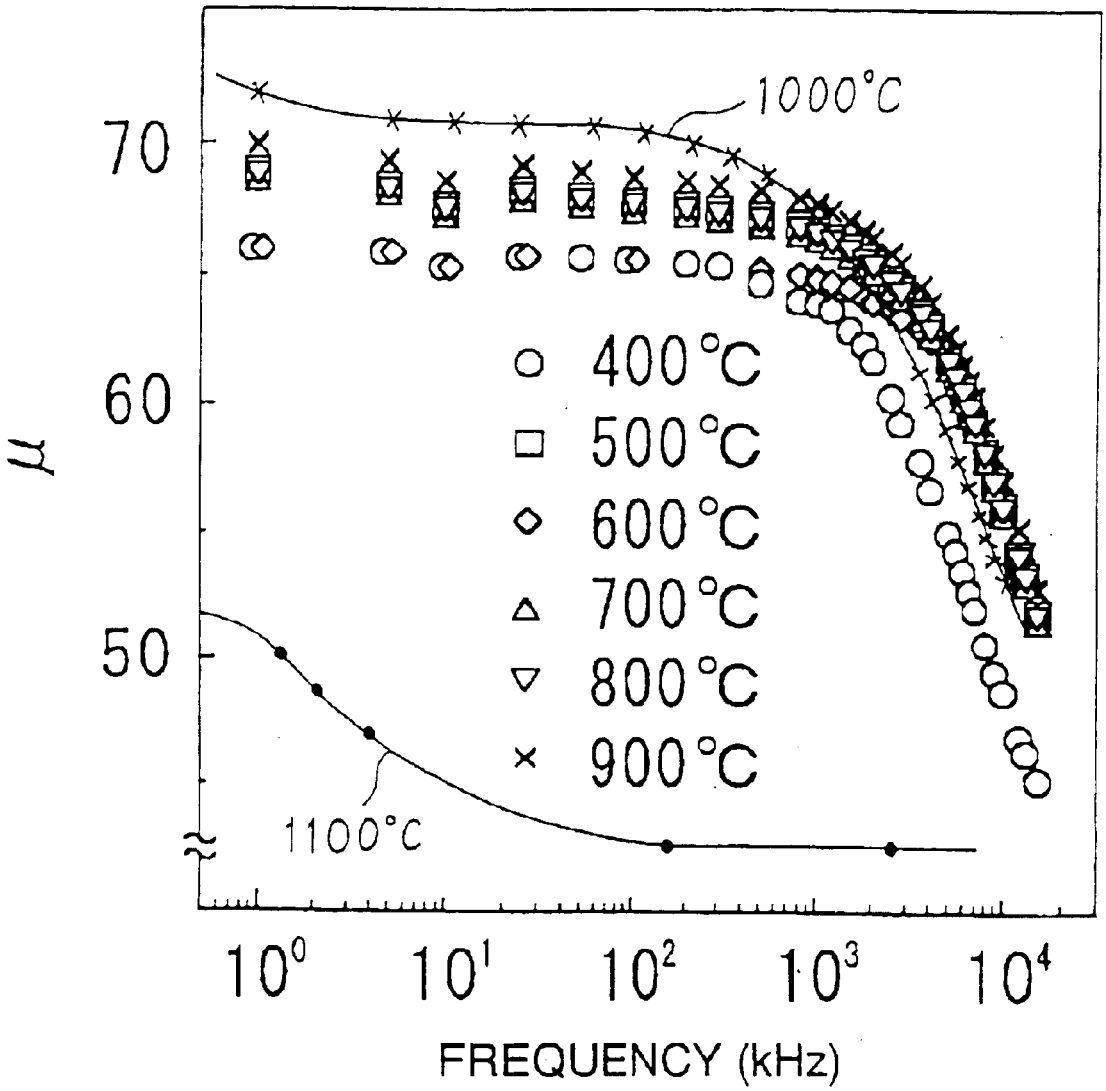
FIG. 3 is a view showing the heat-treatment temperature dependency of the frequency characteristic of the powder core.
Figure 4:
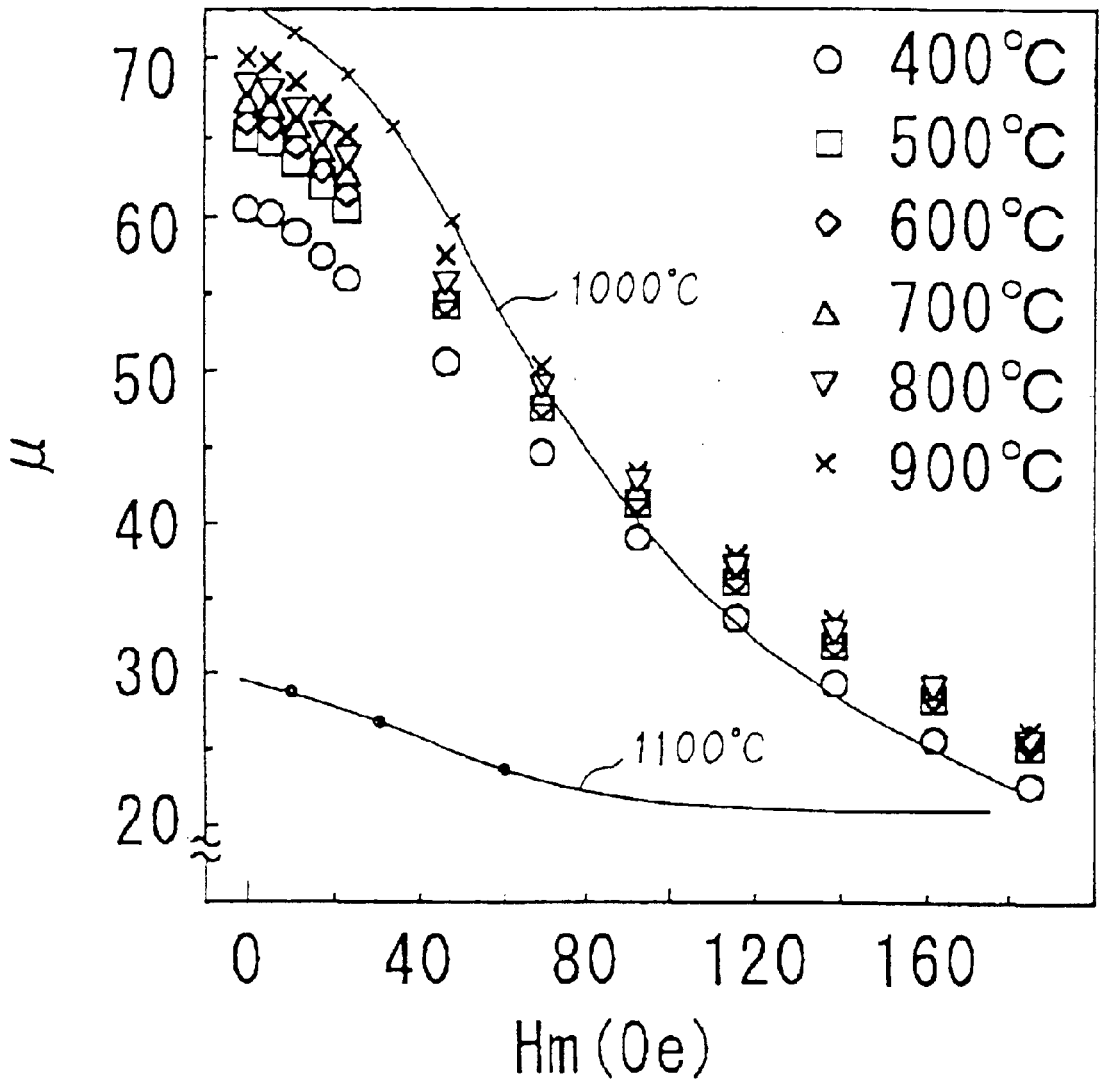
FIG. 4 is a view showing the heat-treatment temperature dependency of the d.c. superposition characteristic of the powder core.

Each powder core was packed into a case made of an insulator and provided with a winding. By the use of the precision meter 4284A manufactured by HP, the d.c. superposition characteristic was measured. The result is shown in FIG. 3. By the use of the impedance analyzer 4194A manufactured by HP, the frequency characteristic of $\mu$ was measured. The result is shown in FIG. 4 As seen from FIG. 3 and FIG. 4, the powder cores treated at the heat treatment temperature not lower than 500° C. were excellent in both of the d.c. superposition characteristic and the frequency characteristic. Presumably, this is because a glass layer of $SiO_2$ and MgO was formed at the temperature not lower than 500° C.

For the powder cores heat treated at the above-mentioned temperatures, the resistivity was measured. As a comparative example, powder cores were produced in the manner similar to Example 1 by the use of the magnetic powder same as that of Example 1 with 1.0 wt % silicone resin alone mixed thereto. In the manner similar to this Example, the powder cores were heat treated at 400° C., 500° C., 600° C., 700° C., 800° C., 900° C., 1000° C., and 1100° C., respectively, for 2 hours in a nitrogen atmosphere to carry out heat treatment of the silicone resin and removal of distortion upon forming the powder. For these powder cores, the resistivity was similarly measured. The result is shown FIG. 5.

Figure 5:
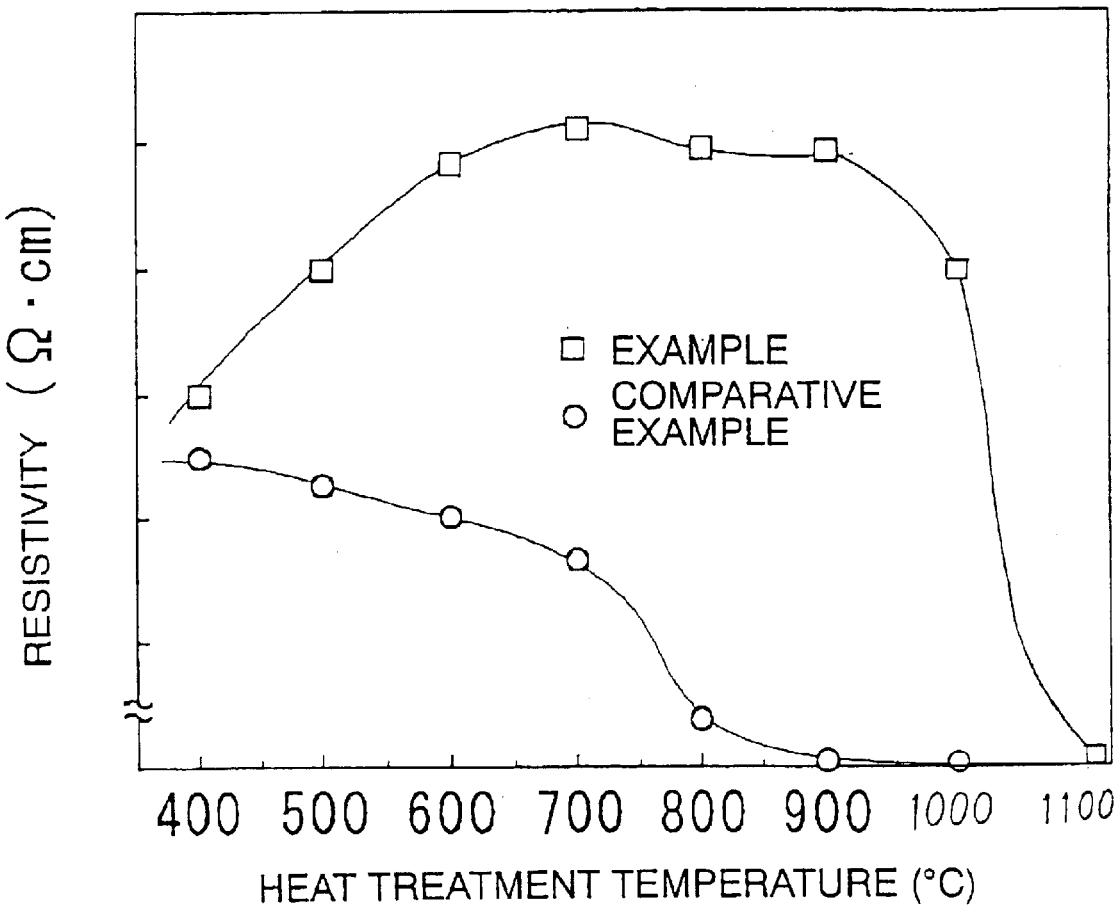
FIG. 5 is a view showing the frequency characteristics of the powder core according to the example 1 and the powder core of the comparative example.

From FIG. 5, it is understood that, in the powder cores of the comparative example with the silicone resin alone added thereto, the resistivity is lowered as the heat treatment temperature is elevated and insulation is destructed at a high temperature of 900° C. On the other hand, in this example, the resistivity is improved following the elevation of the heat treatment temperature and insulation is kept up to 100° C. From the result, it is understood that, according to this invention, sufficient insulation is assured at high-temperature heat treatment and magnetic characteristics are thereby improved.

EXAMPLE 3

Next, description will be made of Example 3. By the use of the alloy powder comprising 5.0 wt % Si, 0.5 wt % O, and balance Fe and used in Sample 1 of Example 1, a toroidal powder core having an outer diameter of 50 mm, an inner diameter of 25 mm, and a height of 20 mm was produced by the use of a die. Next, the toroidal powder core was subjected to heat treatment for removing distortion. A gap of 5 mm was inserted in a direction perpendicular to a magnetic path. A magnet wire having an outer diameter of 1.8 mm was wound around the powder core to produce a reactor.

Measurement was made of the inductance of the reactor upon d.c. superposition of 40A. As a result, the inductance was equal to 550 $\mu$H. Then, the reactor was connected to a typical switching power supply having an output power level on the order of 2000 W with an inverter-control active filter mounted thereto. Then, the circuit efficiency was measured. Herein, a load resistance was connected to an output side. The circuit efficiency was calculated by dividing the output power by the input power. The result is shown in Table 3.

As a comparative example, the toroidal core exactly same in dimension as the example was prepared by the use of an Fe-based amorphous thin strip having a width of 20 mm. After a gap was formed so that the inductance is exactly equal to that of the example, a winding of 60 turns was provided. Then, the inductance was measured. As a result, the inductance was equal to 530 $\mu$H. Next, in the manner exactly same as that in the example, the switching power supply is connected and the circuit efficiency was measured. The result is also shown in Table 3.

TABLE 3

| | Input voltage (W) | output voltage(W) | efficiency (%) |
|---|---|---|---|
| Example | 1980 | 1820 | 91.9 |
| Comparative Example | 1960 | 1770 | 90.3 |

From Table 3, it is understood that the reactor in this example is higher in circuit efficiency than the comparative example. Presumably, this is because the amorphous core requires insertion of a large gap, which causes generation of beat, and magnetic flux leakage around the gap adversely affects the efficiency.

EXAMPLE 4

The alloy powder prepared by water atomization and comprising 3.0 wt % Si, 0.5 wt % O, and balance Fe was classified into 150 $\mu$m or less. Next, 1.0 wt % Si-based resin as a binder and 1.0 wt % MgO were mixed thereto. Then, by the use of a forming die, die-forming was carried out under the pressure of 10 ton/cm$^2$ to produce a compact body having an outer diameter of 15 mm, an inner diameter of 10 mm, and a height of 5 mm. The compact body had a density of 6.8 g/cm$^3$. Thereafter, the compact body was held in an inactive atmosphere at 800° C. for one hour and then gradually cooled down to the room temperature. Next, the compact body was provided with a primary winding of 15 turns and a secondary winding of 15 turns. By the use of the a.c. BH Analyzer SY-8232 manufactured by Iwatsu Electric, measurement was made of the magnetic permeability and the core loss characteristic at 20 kHz and 0.1T.

As a comparative example, a magnetic core having an exactly same shape was prepared by punching a 3% silicon steel plate having a thickness of 0.1 mm by the use of a die and forming a laminated structure using resin. Then, heat treatment for removing distortion was carried out. Thereafter, the magnetic core is provided with a gap so that the d.c. permeability $\mu$ is substantially equal to that of the example. In the manner similar to the example, primary and secondary windings were provided and a.c. magnetic properties were measured. The results are shown in Table 4.

TABLE 4

| | $\mu_{20\ kHz}$ | core loss (kW/m$^3$) |
|---|---|---|
| Example | 70 | 500 |
| Comparative Example | 50 | 3000 |

As seen from Table 4, it is understood that the magnetic core prepared in this example is excellent in magnetic properties at a high frequency as compared with the comparative example.

EXAMPLE 5

For pure iron and a plurality of compositions, 6 lots in total, comprising 1.0, 3.0, 5.0, 7.0, 9.0, and 11.0 wt % Si, 0.5±0.1 wt % O, and balance Fe, the alloy powder was prepared by water atomization and classified into 150 $\mu$m in the manner similar to Example 1.

Figure 6:
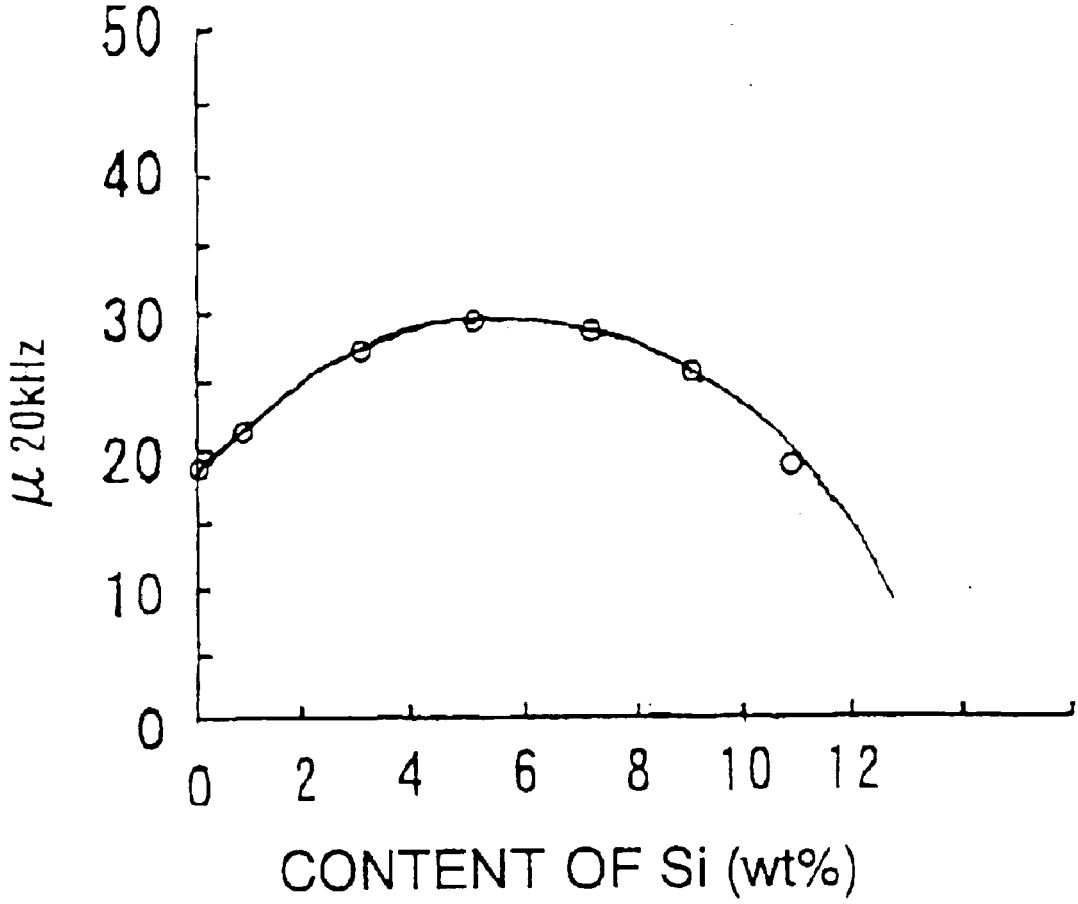
FIG. 6 is a view showing A.C. permeability in a powder core according to example 5.

Next, 1.0 wt % Si resin (silicone resin) and 1.0 wt % MgO were added as a binder thereto. By the use of a die, magnetic cores of a toroidal shape having an outer diameter of 60 mm, an inner diameter of 35 mm, and a height of 20 mm were formed under the forming pressure of 5–15 ton/cm$^2$ so that the relative density is not smaller than about 85%. Thereafter, heat treatment for removing distortion was carried out in a nitrogen atmosphere at 850° C. Then, a winding of 90 turns was provided by the use of a magnet wire. Then, the inductance upon d.c. superposition of 20A (12000 A/m) was measured at the frequency of 20 kHz. From the inductance value, the a.c. permeability was calculated. The result is shown in FIG. 6. From FIG. 6, it is understood that $\mu_{20kHz}$ is equal to 20 or more when the content of Si is 1.0–10.0 wt %.

Next, the core loss was measured under the condition of 20 kHz and 0.1T. As a result, the core loss was not greater than 1000 kW/m$^3$ for the magnetic cores except the one made of pure iron.

Next, in order to examine mounting characteristics of the reactors, the reactors were connected to a switching power supply used in a commercial air conditioner and having an output power of 2 kW with an active filter mounted thereto. Then, the circuit efficiency was measured. Herein, a general electronic load apparatus was connected to an output side. The circuit efficiency was calculated by dividing the output power by the input power. The result is shown in Table 5.

TABLE 5 circuit efficiency upon variation in Si content

| | Si content | | | | | | |
|---|---|---|---|---|---|---|---|
| output power | pure iron | 1.0% | 3.0% | 5.0% | 7.0% | 9.0% | 11.0% |
| 1000 W | 87.5 | 93.0 | 93.5 | 93.8 | 93.9 | 93.6 | 92.2 |
| 2000 W | 87.1 | 92.1 | 93.1 | 93.2 | 93.5 | 93.1 | 91.8 |

From Table 5, it is understood that, for example, a high efficiency of 93% or more is achieved at 1000W when the Si content falls within a range of 1.0–10.0 wt % which is coincident with the composition range showing the core loss of 1000 kW/m$^3$ and the permeability of 20 or more at 12000 A/m.

EXAMPLE 6

The powder comprising 4.5 wt % Si and balance Fe was prepared by gas atomization and classified into 150 $\mu$m. Thereafter, at a constant temperature and in an atmosphere appropriately controlled, samples of alloy powder containing 0.05, 0.1, 0.25, 0.5, 0.75, 1.0, and 1.25 wt % O were produced.

Figure 7:
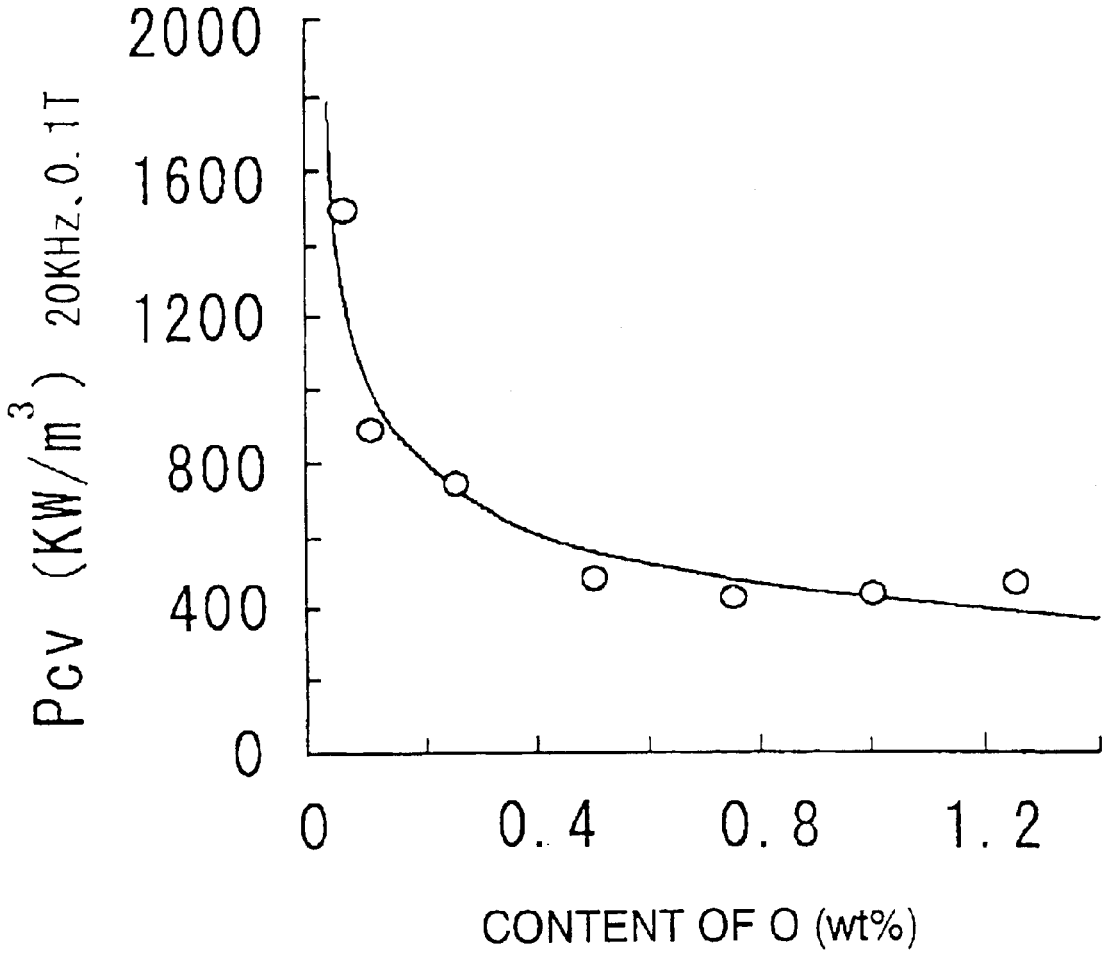
FIG. 7 is a view showing a core loss in a powder core according to example 6.

Next, a binder was mixed to the alloy in the manner exactly similar to that mentioned in conjunction with Examples 4 and 5. Thereafter, in the manner exactly similar to that in Example 5, toroidal cores having a similar dimension were produced under the forming pressure of 20 ton/cm$^2$ so that the compact body had a density of 92%. After the heat treatment for removing distortion, each of the magnetic cores was provided with a winding in the manner exactly similar to that in Example 1. Under the condition of 20 kHz and 0.1T, the core loss was measured. The result is shown in FIG. 7. From FIG. 7, it is understood that the core loss is drastically deteriorated when the content of 0 is smaller than 0.1 wt %.

Next, a winding was provided in the manner exactly similar to that in Example 5. The inductance at 20 kHz upon d.c. superposition of 20A (12000 A/m) was measured and the a.c. permeability was calculated. As a result, g 20 kHz of the magnetic core with 1.25 wt % O was equal to 19 while $\mu_{20kHz}$ in other magnetic cores was equal to 20 or more.

Then, in the manner exactly same as that in Example 5, the mounting characteristic of the reactor was measured. The result is shown in Table 6.

TABLE 6 circuit efficiency upon variation in O content

| | O content | | | | | | |
|---|---|---|---|---|---|---|---|
| output power | 0.05% | 0.1% | 0.25% | 0.5% | 0.75% | 1.0% | 1.25% |
| 1000 W | 92.1 | 93.1 | 93.2 | 93.3 | 93.3 | 93.2 | 91.7 |
| 2000 W | 92.0 | 93.0 | 93.1 | 93.2 | 93.0 | 93.0 | 91.3 |

From Table 6, it is understood that, for example, a high efficiency of 93% or more is achieved at 1000W when the 0 content falls within a range of 1.0–1.0 wt % which is coincident with the composition range showing the core loss of 1000 kW/m$^3$ and the $\mu_{20kHz}$ of 20 or more.

As described above, the powder core according to this invention is useful as a magnetic core of a choke coil used at a high frequency.

What is claimed is:

1. A high-frequency reactor comprising a powder core and a winding wound around said powder core, said powder core being obtained by compaction-forming magnetic powder, wherein said magnetic powder is an alloy comprising 1–10 wt % Si, 0.1–1.0 wt % O, and balance Fe, an insulator comprising $SiO_2$ and MgO as main components being interposed between magnetic powder particles, said magnetic powder particles having a particle size of 150 $\mu$m or less, and wherein said powder core has an a.c. permeability $\mu_{20kHz}$ of 20 or more under an applied d.c. magnetic field of 12000 A/m and a core loss of 1000 kW/m$^3$ or less under the condition of 20 kHz and 0.1 T.

2. The high-frequency reactor according to claim 1, wherein a gap or a nonmagnetic substance arranged at one or more positions occupies 10% or less of a magnetic path length.

3. A high-frequency reactor comprising a powder core according to claim 1 and said winding wound around said powder core.

* * * * *